US006577844B2

(12) United States Patent
Kamei

(10) Patent No.: US 6,577,844 B2
(45) Date of Patent: Jun. 10, 2003

(54) IMAGE FORMING APPARATUS AND PAPER CARRYING CONTROLLING METHOD FOR ACHIEVING HIGH SPEED BOTH SIDES PRINTING WITH A LIMITED NUMBER OF DRIVE SOURCES

(75) Inventor: Chikashi Kamei, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/991,860

(22) Filed: Nov. 14, 2001

(65) Prior Publication Data

US 2002/0061215 A1 May 23, 2002

(30) Foreign Application Priority Data

Nov. 17, 2000 (JP) ..... 2000-351074

(51) Int. Cl.[7] ..... G03G 15/00
(52) U.S. Cl. ..... 399/401; 871/301
(58) Field of Search ..... 399/401, 402, 399/381, 75; 271/298, 301

(56) References Cited

U.S. PATENT DOCUMENTS

| | | | | | |
|---|---|---|---|---|---|
| 4,918,490 | A | * | 4/1990 | Stemmle | 399/401 |
| 4,928,127 | A | * | 5/1990 | Stemmle | 399/401 |
| 5,055,885 | A | * | 10/1991 | Yoshikado et al. | 399/401 |
| 5,132,742 | A | * | 7/1992 | Goto | 399/401 |
| 6,041,213 | A | * | 3/2000 | Yanagi | 399/401 |
| 6,477,352 | B2 | * | 11/2002 | Takahashi et al. | 399/401 |

* cited by examiner

*Primary Examiner*—Joan Pendegrass
(74) *Attorney, Agent, or Firm*—Frishauf, Holtz, Goodman & Chick, P.C.

(57) ABSTRACT

Return roller and carry roller are rotated by one drive source. To the carry roller which nips and holds paper when the paper is held, a driving force of the drive source is transmitted by a clutch only when the return roller carries out the paper toward a return direction. There is controlled paper carry by repeating a step of feeding an n-th sheet of paper on which the image formation on one side is completed to an image formation section, and feeding an n+1-th sheet of paper to a paper side reversal section, and a step of, under the state where the n+1-th sheet of paper is held at the paper side reversal section, ejecting the n-th sheet of paper on which the image formation on both sides is completed, and feeding an n+2-th sheet of paper to the return section.

4 Claims, 3 Drawing Sheets

IMAGE FORMING APPARATUS AND PAPER CARRYING CONTROLLING METHOD FOR ACHIEVING HIGH SPEED BOTH SIDES PRINTING WITH A LIMITED NUMBER OF DRIVE SOURCES

CROSS-REFERENCE TO RELATED APPLICATIONS

This application is based upon and claims the benefit of priority from the prior Japanese Patent Application No. 2000-351074, filed Nov. 17, 2000, the entire contents of which are incorporated herein by reference.

BACKGROUND OF THE INVENTION

1. Field of the Invention

This invention relates to an image forming apparatus which performs both sides printing by re-feeding paper on which image formation on one side thereof is finished by using an image formation mechanism for performing the image formation on one side of paper to the image formation mechanism after reversing the paper at a paper carry route, and by performing the image formation by using the image formation mechanism, and to a controlling method of paper carry at the image forming apparatus.

2. Description of the Related Art

Both sides printing by an electrophotographic apparatus and the like is realized by reversing paper on which image formation on one side thereof is finished and by re-feeding the paper to an image formation position by an image formation mechanism.

In such an image forming apparatus, a paper carry route becomes extremely long. Owing to this, if it is designed so as to perform printing on another sheet of paper after completing the both sides printing on one sheet of paper, a printing speed of the both sides printing becomes extremely slow.

Here, high-speed both sides printing can be realized by taking a design where plural sheets of paper can individually be carried in the paper carry route by providing plural motors. However, if plural motors are provided in this manner, cost of parts increases while a process burden of a CPU for controlling the motors increases since it becomes necessary to control more motors individually.

BRIEF SUMMARY OF THE INVENTION

An object of the present invention is to enable high-speed both sides printing with a number of drive sources limited to the minimum.

According to an aspect of the invention, there is provided an image forming apparatus as below.

An image forming apparatus comprising;

an image formation mechanism which forms an image on a paper; a paper carry mechanism which carries the paper at a paper carry route having an image formation section which carries the paper toward one direction so as to make the image formation mechanism perform image formation on the paper, a return section which once takes in the paper carried out from the image formation section and carries out the paper toward a predetermined return direction being different from the direction toward the image formation section while reversing a carry direction, and a paper side reversal section which feeds the paper reversed to the other side after passing the image formation section at the last time to the image formation section at a predetermined timing after temporally stopping and holding the paper carried out from the return section; a drive source which rotates both a return roller provided in the paper carry mechanism in order to take in the paper carried out from the image formation section to the return section and to carry out the paper from the return section to the return direction, and at least one carry roller provided in the paper carry mechanism in order to carry the paper at the paper side reversal section; a clutch which transmits a driving force of the drive source to the carry roller having a possibility to nip and hold the paper when the paper is temporally stopped and held among the carry rollers only when the drive source is operating so that the return roller will carry the paper toward the return direction; and a carry control section which controls the paper carry by repeating a step of feeding the n-th sheet of paper on which the image formation on only one side is completed from the paper side reversal section to the image formation section, and feeding the n+1-th sheet of paper on which the image formation on only one side is completed from the return section to the paper side reversal section, and a step of, under the state where the n+1-th sheet of paper is held at the paper side reversal section, ejecting the n-th sheet of paper on which the image formation on both sides is completed, and feeding the n+2-th sheet of paper from the image formation section to the return section after taking-in the paper to the image formation area and performing the image formation on one side.

According to another aspect of the invention, there is provided a paper carry controlling method as below.

A paper carry controlling method in an image forming apparatus comprising;

an image formation mechanism which forms an image on a paper; a paper carry mechanism which carries the paper at a paper carry route having an image formation section which carries the paper toward one direction so as to make the image formation mechanism perform image formation on the paper, a return section which once takes in the paper carried out from the image formation section and carries out the paper toward a predetermined return direction being different from the direction toward the image formation section while reversing a carry direction, and a paper side reversal section which feeds the paper reversed to the other side after passing the image formation section at the last time to the image formation section at a predetermined timing after temporally stopping and holding the paper carried out from the return section; a drive source which rotates both a return roller provided in the paper carry mechanism in order to take in the paper carried out from the image formation section to the return section and to carry out the paper from the return section to the return direction, and at least one carry roller provided in the paper carry mechanism in order to carry the paper at the paper side reversal section; and a clutch which transmits a driving force of the drive source to the carry roller having a possibility to nip and hold the paper when the paper is temporally stopped and held among the carry rollers only when the drive source is operating so that the return roller will carry the paper toward the return direction, the paper carry controlling method being performed by repeating a step of feeding the n-th sheet of paper on which the image formation on only one side is completed from the paper side reversal section to the image formation section, and feeding the n+1-th sheet of paper on which the image formation on only one side is completed from the return section to the paper side reversal section, and a step of, under the state where the n+1-th sheet of paper is held at the paper side reversal section, ejecting the n-th sheet of paper on which the image formation on both sides is completed, and feeding the n+2-th sheet of paper from the image formation section to the return section after taking-in the paper to the image formation area and performing the image formation on one side.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, an explanation will be given of an embodiment of the present invention with reference to the drawings.

Figure 1:
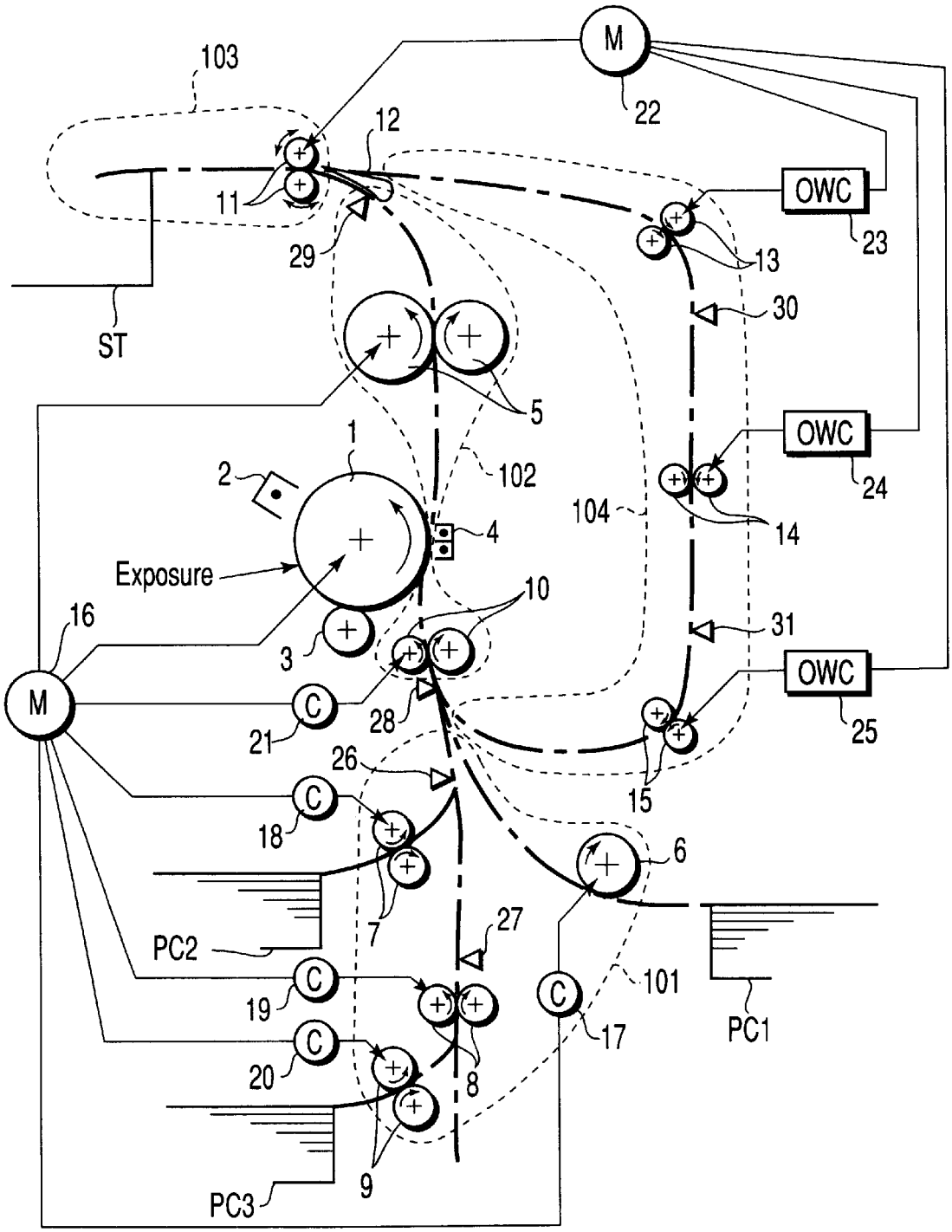
FIG. 1 is a diagram showing a structure of a mechanism portion of an electrophotographic apparatus according to an embodiment of the present invention.

FIG. 1 is a diagram showing a structure of a mechanism portion of an electrophotographic apparatus according to this embodiment.

As shown in FIG. 1, the electrophotographic apparatus in this embodiment has a photosensitive drum 1, an electrification device 2, a developing device 3, a transferring device 4, a fixing roller 5, a first feeding roller 6, a second feeding roller 7, a third feeding roller 8, a fourth feeding roller 9, a register roller (referred to as RGT roller hereinafter) 10, an ejecting roller 11, an ADU (auto duplex unit) gate 12, ADU rollers 13, 14, and 15, a main motor 16, a first feeding clutch 17, a second feeding clutch 18, a third feeding clutch 19, a fourth feeding clutch 20, an RGT clutch 21, an ADU motor 22, oneway clutches 23, 24, and 25, a first carry route sensor (referred to as TR1 sensor hereinafter) 26, a second carry route sensor (referred to as TR2 sensor hereinafter) 27, an RGT sensor 28, an ejection sensor 29, a first jam detection sensor (referred to as first ADU sensor hereinafter) 30, and a second jam detection sensor (referred to as second ADU sensor hereinafter) 31.

The electrification device 2, the developing device 3, and the transferring device 4 are arranged along a surface of the photosensitive drum 1 with a predetermined position relation, and perform processes of the respective steps of an electrophotographic process with exposure performed separately at a predetermined position. Owing to this, a toner image is formed for the paper passing through between the photosensitive drum 1 and the transferring device 4. The toner image is formed on a side of the paper which contacts the photosensitive drum 1. By pressing and melting the toner image formed on the paper by using the fixing roller 5, the image is fixed.

A paper route is indicated by dashed lines in FIG. 1. The paper route is formed with the photosensitive drum 1, the fixing roller 5, the first feeding roller 6, the second feeding roller 7, the third feeding roller 8, the fourth feeding roller 9, the RGT roller 10, the ejecting roller 11, the ADU gate 12 and the ADU rollers 13, 14, and 15, and guide members (not shown).

The photosensitive drum 1, the fixing roller 5, the first feeding roller 6, the second feeding roller 7, the third feeding roller 8, the fourth feeding roller 9, and the RGT roller 10 all rotate in an arrowed direction shown in FIG. 1 by receiving a driving force from the main motor 16. Moreover, the ejecting roller 11 and the ADU rollers 13, 14, and 15 all rotates in the arrowed direction shown in FIG. 1 by receiving the driving force from the ADU motor 22.

The first feeding roller 6 feeds paper from a paper cassette PC1, the second feeding roller 7 feeds paper from a paper cassette PC2, and the third feeding roller 8 and the fourth feeding roller 9 feed paper from a paper cassette PC3 respectively to the RGT roller 10.

The RGT roller 10 feeds the paper to the fixing roller 5 through between the photosensitive drum 1 and the transferring device 4.

The ejecting roller 11 can rotate in a normal direction and a reverse direction in accordance with a rotation direction of the ADU motor 22. Under a reverse rotation state, the ejecting roller 11 pulls in the paper to be carried by the fixing roller 5, and ejects the paper to a stacker ST as need arises. Moreover, under a normal rotation state, the ejecting roller 11 feeds the paper which is nipped and held to the ADU roller 13.

When the paper is fed to the ejecting roller 11 by the fixing roller 5, the ADU gate 12 is pushed-up by the paper as shown in FIG. 1 so that it does not interfere with the paper carry. Moreover, the ADU gate 12 falls with its own weight so as to block the route from the fixing roller 5 to the ejecting roller 11 after a back edge from a carry direction of the paper to be fed to the ejecting roller 11 by the fixing roller 5 passes through, and it forms the route reaching the ADU roller 13 from the ejecting roller 11.

The ADU rollers 13, 14, and 15 carry the paper to be carried from the ejecting roller 11 in order, and feed the paper to the RGT roller 10 in the same carry direction.

The main motor 16 generates the driving force for rotating the photosensitive drum 1, the fixing roller 5, the first feeding roller 6, the second feeding roller 7, the third feeding roller 8, the fourth feeding roller 9, and the RGT roller 10, respectively.

The first feeding clutch 17, the second feeding clutch 18, the third feeding clutch 19, and the fourth feeding clutch 20 transmit/intercept driving from the main motor 16 to the first feeding roller 6, the second feeding roller 7, the third feeding roller 8, and the fourth feeding roller 9, respectively.

The ADU motor 22 generates the driving force for rotating the ejecting roller 11, and the ADU rollers 13, 14, and 15, respectively. The ADU motor 22 can perform both the normal rotation and the reverse rotation, and generates the driving force for normally-rotating the ejecting roller 11 during the normal rotation and the driving force for reversely-rotating the ejecting roller 11 during the reverse rotation, respectively.

The one-way clutches 23, 24, and 25 have a well-known structure which transmits only the driving force in one direction. The one-way clutches 23, 24, and 25 have a mesh direction being the normal-rotation direction of the ADU motor 22, and rotate the ADU rollers 13, 14, and 15 in the arrowed direction shown in FIG. 1 when the ADU motor 22 is in the normal rotation. Moreover, concerning the one-way clutches 23, 24, and 25, the reverse-rotation direction of the ADU motor 22 is an idle rotation direction.

The TR1 sensor 26 is arranged at a position through which the paper to be carried by the second feeding roller 7 and the paper to be carried by the third feeding roller 8 pass, and detects the existence of the paper at the position.

The TR2 sensor 27 is arranged at a position through which the paper carried by the third feeding roller 8 passes, and detects the existence of the paper at the position.

The RGT sensor 28 is arranged near the RGT roller 10 at a position through which the paper to be fed to the RGT roller 10 by the first feeding roller 6, the second feeding roller 7, the third feeding roller 8, and the ADU roller 15 passes, and detects the existence of the paper at the position.

The ejection sensor 29 is arranged near the ADU gate 12 at a position through which the paper fed from the fixing roller 5 to the ejecting roller 11 passes, and detects the existence of the paper at the position.

The first ADU sensor 30 and the second ADU sensor 31 are respectively arranged at a position through which the paper to be fed from the ADU roller 13 to the ADU roller 14 passes and at a position through which the paper to be fed from the ADU roller 14 to the ADU roller 15 passes, and detect the existence of the paper at the positions, respectively.

The carry route of the paper formed with the arrangement as described above can roughly be classified into a feed section 101, an image formation section 102, a ejection/return section 103, and a paper side reversal section 104 as shown by circling with broken lines in FIG. 1.

The feeding section 101 is a section for feeding a new sheet of paper to the image formation section 102. The image formation section 102 is a section for performing an image formation operation to the paper. The paper ejection/return section 103 is a section for ejecting the paper on which the necessary image formation is completed to the stacker ST. Moreover, the ejection/return section 103 is a section for returning the paper on which the image formation on only one side is completed to the paper side reversal section 104. The paper side reversal section 104 is a section for reversing the paper when it passes the image formation section 102.

Figure 2:
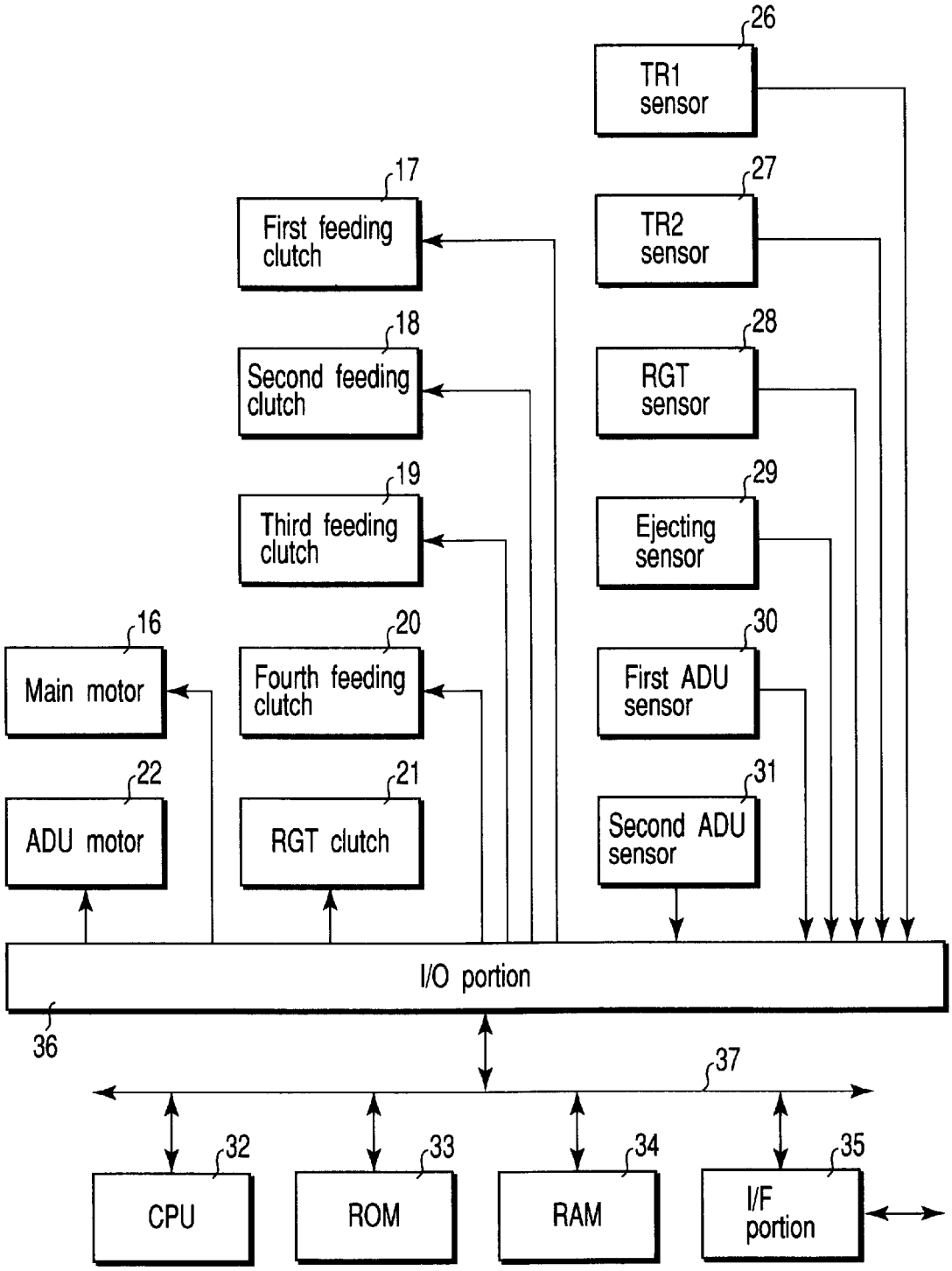
FIG. 2 is a block diagram of a control system for paper carry of the electrophotographic apparatus shown in FIG. 1.

FIG. 2 is a block diagram showing a control system for the paper carry of the electrophotographic apparatus in this embodiment. Besides, the parts being the same as those in FIG. 1 are given the same numerals respectively, and the detailed explanations thereof are omitted.

As shown in FIG. 2, there are comprised a CPU 32, a ROM 33, a RAM 34, an interface portion (referred to as IF portion hereinafter) 35, and an input/output portion (referred to as I/O portion hereinafter) 36 as the control system, and they are connected to each other via a bus 37.

The CPU 32 controls the main motor 16 and the ADU motor 22, or the first feeding clutch 17, the second feeding clutch 18, the third feeding clutch 19, the fourth feeding clutch 20, and the RGT clutch 21 while referring to the respective detected results of the TR1 sensor 26, the TR2 sensor 27, the RGT sensor 28, the ejection sensor 29, the first ADU sensor 30, and the second ADU sensor 31. The CPU 32 realizes the control by a software process based on an operation program stored in the ROM 33.

The ROM 33 stores data and the like that are necessary for the operation program used by the CPU 32 or the CPU 32 to perform various sorts of processes.

The RAM 34 is used as a work area and the like for the CPU 32 to perform the various sorts of processes.

The IF portion 35 performs an interface process for a main CPU (not shown) and the like for totally-controlling the operation of the whole electrophotographic apparatus in this embodiment and the CPU 32 to give/receive the various sorts of data.

To the I/O portion 36, there are connected the main motor 16, the ADU motor 22, the first feeding clutch 17, the second feeding clutch 18, the third feeding clutch 19, the fourth feeding clutch 20, the RGT clutch 21, the TR1 sensor 26, the TR2 sensor 27, the RGT sensor 28, the ejection sensor 29, the first ADU sensor 30, and the second ADU sensor 31, respectively. The I/O portion 36 performs the input/output process of a signal relating to each of these portions.

Next, an explanation will be given of the operation of the electrophotographic apparatus composed as above. Besides, the operation itself for the image formation on the paper is similar to that of the conventional electrophotographic apparatus so that an explanation thereof is omitted. Here, an explanation will mainly be given of the operation of the paper carry for the both sides printing.

Figure 3:
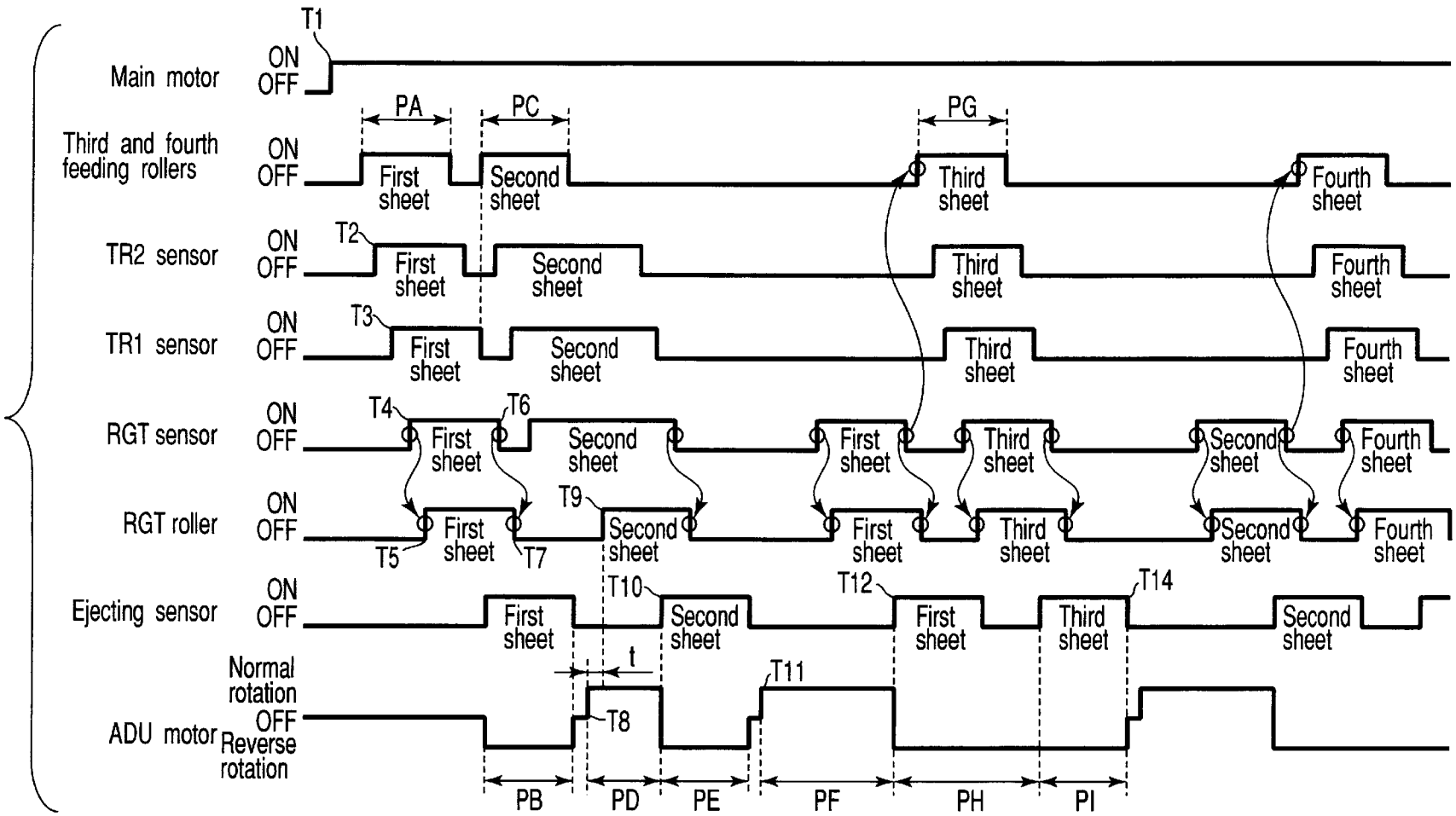
FIG. 3 is a timing diagram showing timing for the paper carry for a case where both sides printing is performed.

FIG. 3 is a timing drawing showing the timing of the paper carry of the case where the both sides printing is performed by using the paper stored in the paper cassette PC3 in FIG. 1.

An explanation will be given of the operation of each portion at the time with reference to FIG. 3.

At first, the CPU 32 starts up the main motor 16 when a start of printing operation is requested by the main CPU (not shown). However, the CPU 32 keeps the first to the fourth feeding clutches 17 to 20 and the RGT clutch 21 under an intercepted state at the time. Owing to this, the photosensitive drum 1 and the fixing roller 5 start the rotation here (timing T1).

After this, when performing the image formation becomes possible, the CPU 32 rotates the third feeding roller 8 and the fourth feeding roller 9 by making the third feeding clutch 19 and the fourth feeding clutch 20 into a transmission state, and feeds the first sheet of paper to the RGT roller 10 (period PA).

Now, when the paper is carried by the third feeding roller 8 and the fourth feeding roller 9, the TR2 sensor 27, the TR1 sensor 26, and the RGT sensor 28 are turned-on in order (timings T2, T3, and T4). Then, the CPU 32 makes the RGT clutch 21 into the transmission state and starts the rotation of the RGT roller 10 responding to the fact that the RGT sensor 28 is turned-on (timing T5) In this manner, the first sheet of paper is taken-in to the image formation section 102 by the rotation of the RGT roller 10, and the image formation on the obverse side of the paper (the side facing to the photosensitive drum 1 at the time) is performed. Then, if the back edge of the first sheet of paper passes through the RGT sensor 28 and the RGT sensor 28 is turned-off (timing T6), the CPU 32 makes the RGT clutch 21 into the intercepted state and stops the rotation of the RGT roller 10 at about the timing at which the back edge of the first sheet of paper passes thorough the RGT roller 10 (timing T7). At the time, the first sheet of paper is already nipped and held by the fixing roller 5, and is carried toward the ejecting roller 11 by the fixing roller 5.

When the first sheet of paper arrives at the ejection sensor 29 and the ejection sensor 29 is turned-on, the CPU 32 reverses the ADU motor 22 during the period where the ejection sensor 29 continues to be on (period PB). In this manner, during the period PB, the first sheet of paper is taken-in to the ejection/return section 103, and the ejecting roller is suspended under the state where the back edge of the first sheet of paper is nipped and held by the ejecting roller 11.

Although the first sheet of paper is carried as above, when the back edge of the first sheet of paper passes through the TR1 sensor 26 and the TR1 sensor 26 is turned-off, the CPU 32 rotates the third feeding roller 8 and the fourth feeding roller 9 by making the third feeding clutch 19 and the fourth feeding clutch 20 into the transmission state, and feeds the second sheet of paper to the RGT roller 10 (period PC). That is to say, the second sheet of paper is fed to the RGT roller 10 at the same time as carrying the first sheet of paper from the image formation section 102 to the ejection/return section 103.

Now, if the period PB during which the ejection sensor 29 is turned-on by the first sheet of paper ends, the CPU 32 then starts the rotation of the ADU motor 22 from the timing at which some time has passed (timing T8) Owing to this, the first sheet of paper nipped and held by the ejecting roller 11 is fed from the ejection/return section 103 to the paper side reversal section 104 by the ejecting roller 11. The mesh direction of the one-way clutches 23, 24, and 25 is the normal rotation of the ADU moto 22 so that the ADU rollers 13, 14, and 15 also rotate at the time, and the first sheet of paper fed by the ejecting roller 11 is pulled-in to the paper side reversal section 104 by these ADU rollers 13, 14, and 15.

On the other hand, the CPU 32 starts the rotation of the RGT roller 10 responding to the fact that a fixed time t (for example, 0.5 second) has passed from the timing T8 at which the normal rotation of the ADU motor 22 starts (timing T9). Owing to this, the second sheet of paper carried to the RGT roller 10 is taken-in to the image formation section 102, and the image formation on the obverse side is performed. Besides, although the timing at which the rotation of the RGT roller 10 is started is determined on the basis of the timing besides an ON-timing of the RGT sensor 28, it is only for the case where the second sheet of paper is fed. After this, the CPU 32 performs a rotation control of the RGT roller 10 in accordance with the state of the RGT sensor 28 at the timing that is similar to relations between the above-mentioned a timings T4 and T5, and between the above-mentioned timings T6 and T7.

In this manner, when the second sheet of paper is carried, and it arrives at and turns on the ejection sensor 29, the CPU 32 makes the ADU motor 22 start the reversal rotation (timing T10). Owing to this, the normal rotation of the ADU motor 22 is finished, and the carry of the first sheet of paper from the ejection/return section 103 to the paper side reversal section 104 is performed during the period from the timing T8 to the timing T10, during which the ADU motor 22 is normally-rotating (period PD). Besides, the fixed period t is a waiting time for adjusting the period PD to the length in which the entire first sheet of paper can surely be carried to the paper side reversal section 104, and it is set as it is considered appropriate by considering a paper carry speed or a dimension condition among the respective rollers.

Then, the CPU 32 reverses the ADU motor 22 while there continues the state where the ejection sensor 29 is turned-on by the second sheet of paper (period PE). In this manner, the ejecting roller 11 is suspended under the state where the second sheet of paper is taken-in to the ejection/return section 103, and the back edge of the second sheet of paper is nipped and held by the ejecting roller 11 during the period PE. At the time, although the first sheet of paper exists in the paper side reversal section 104 and is nipped and held by at least any one of the ADU rollers 13, 14, and 15, the first sheet of paper stays at the paper side reversal section 104 since these ADU rollers 13, 14, and 15 are stopped due to the fact that the reverse rotation of the ADU motor 22 is in the idle-rotation direction of the one-way clutches 23, 24, and 15.

If the period PE during which the ejection sensor 29 is turned-on by the second sheet of paper ends, the CPU 32 then starts the normal rotation of the ADU motor 22 from the timing at which some time has passed (timing T11). Owing to this, the second sheet of paper nipped and held by the ejecting roller 11 is fed from the ejection/return section 103 to the paper side reversal section 104 by the ejecting roller 11. Since the ADU rollers 13, 14, and 15 also rotate at the time, the second sheet of paper that is fed by the ejecting roller 11 is pulled-in to the paper side reversal section 104 by these ADU rollers 13, 14, and 15.

Moreover, the ADU rollers 13, 14, and 15 rotate in this manner so that the first sheet of paper stacked at the paper side reversal section 104 is delivered from the paper surface reversing section 104 by the ADU rollers 13, 14, and 15. Then, responding to the fact that the first sheet of paper arrives at the RGT sensor 28, there are performed taking-in the paper to the image formation section 102, the image formation on the paper, and delivery of the paper from the image formation section 102 in a similar manner to above. At the time, the side of the paper facing the photo-sensitive drum 1 is a reverse side of the side that passed through the image formation section 102 at the last time, and the image formation on the reverse side is performed. Then, until when the first sheet of paper arrives at the ejection sensor 29 and the ejection sensor 29 is turned-on (timing T12), there is continued the state where pulling-in the second sheet of paper to the paper side reversal section 104 as above and the delivery of the first sheet of paper from the paper side reversal section 104 are performed (period PF).

Now, when the back edge of the first sheet of paper fed to the image formation section 102 for the image formation on the reverse side passes through the RGT sensor 28 and the RGT sensor 28 is turned-off (timing T13), the CPU 32 rotates the third feeding roller 8 and the fourth feeding roller 9 responding to it, and feeds the third sheet of paper to the RGT roller 10 (period PG). In this manner, at the same time as performing the image formation on the reverse side of the first sheet of paper and the delivery of the first sheet of paper from the image formation section 102, there are performed the feed of the third sheet of paper, taking-in the third sheet of paper to the image formation section 102, and the image formation on the obverse side of the third sheet of paper.

At the time, the CPU 32 reverses the ADU motor 22 sometime between the timing T12 at which the first sheet of paper arrives at the ejection sensor 29 and the timing (timing T14) at which the ejection sensor 29 is turned-off at the second time since the timing T12. That is to say, the CPU 32 reverses the ADU motor 22 sometime between the time at which the first sheet of paper arrives at the ejection sensor 29 and the time at which the back edge of the third sheet of paper passes through the ejection sensor 29. As a result, even after the back edge of the first sheet of paper reaches to the ejecting roller 11, the ejecting roller 11 continues the reverse rotation so that the first sheet of paper on which the image formation on the reverse side is completed, that is to say, the first sheet of paper on which the both sides printing is completed is ejected to the stacker ST by the ejecting roller 11 (period PH). Then, the third sheet of paper that reaches to the ejecting roller 11 following the first sheet of paper is taken-in to the eject/return section 103 by the ejecting roller 11 and is stopped under the state where the back edge thereof is nipped and held by the ejecting roller 11 (period PI).

Although the second sheet of paper is taken-in to the paper side reversal section 104 at the start timing T12 during the period PH, the paper stays at the paper side reversal section 104 during the period PH and the period PI since the ADU rollers 13, 14, and 15 do not rotate.

Hereinafter, at similar timings to the relation of the above-mentioned carry timings of the first, second, and third sheets of paper, there are repeatedly performed the image formation on the reverse side of an n-th sheet of paper and ejection thereof, taking-in an n+1-th sheet of paper to the paper side reversal section 104, the feed of an n+2-th sheet of paper, the image formation on the obverse side of the n+2-th sheet of paper, and taking-in the n+2-th sheet of paper to the ejection/return section 103.

In this manner, according to this embodiment, the image formation operation by circulating two sheets of paper can be performed all the time at the image formation section 102, the ejection/return section 103, and the paper side reversal section 104 at the time of performing the both sides printing, and the high-speed both sides printing is possible.

In addition, since this embodiment is designed so that the drive of the ADU rollers 13, 14, and 15 for performing the paper carry at the paper side reversal section 104 will be performed by the ADU motor 22 for driving the ejecting roller 11, a structure thereof is simpler and the process burden of the CPU 32 is less than the case where the drive of the ejecting roller 11 and the drive of the ADU rollers 13, 14, and 15 are performed by individual motors.

Moreover, in this embodiment, clutch control is unnecessary since the one-way clutches 23, 24, and 25 are used in order to make the rotation of the ADU rollers 13, 14, and 15 only in one direction so that the burden to the CPU 32 is less.

Besides, the present invention is not limited by the above-mentioned embodiment. For example, although driving force transmission to the ADU rollers 13, 14, and 15 is performed via the one-way clutches 23, 24, and 25 in the above-mentioned embodiment, other sorts of clutches may also be used. However only, in that case, it is necessary to additionally perform a new clutch control by using the CPU 32.

Moreover, although it is assumed that three ADU rollers 13, 14, and 15 are provided to the paper side reversal section 104, and the one-way clutches 23, 24, and 25 are provided to all of these three ADU rollers 13, 14, and 15 in the above-mentioned embodiment, a number of the rollers provided to the paper side reversal section 104 may be an optional, and moreover, it is sufficient that the one-way clutches are provided only to the rollers having a possibility to nip and hold the paper that is kept at the paper side reversal section 104.

Moreover, factors such as the position relations of various sorts of roller or various sorts of sensor, or a shape of the paper carry route can optionally be changed as long as it does not mar the original function, and the concrete timings for the paper carry are to be changed in accordance with these functional structures.

Moreover, although there is shown an example in which the image forming apparatus according to the present invention is applied to the electrophotographic apparatus in the above-mentioned embodiment, a method of the image formation may be optional, and the present invention is not limited to the application to the electrophotographic apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising;

an image formation mechanism which forms an image on a paper;

a paper carry mechanism which carries the paper on a paper carry route, said paper carry route including: (i) an image formation section which carries the paper in a direction toward the image formation mechanism, (ii) a return section which takes in the paper from the image formation section and then carries out the paper in a return direction different from the direction toward the image formation section while reversing a carry direction, and (iii) a paper side reversal section which reverses the paper from a first side thereof which has passed the image formation section to a second side thereof and feeds the paper reversed to the second side thereof to the image formation section at a predetermined timing after temporally stopping and holding the paper carried out from the return section;

a drive source which rotates both a return roller provided in the paper carry mechanism in order to take in the paper from the image formation section to the return section and to carry out the paper from the return section to the return direction, and at least one carry roller provided in the paper carry mechanism in order to carry the paper at the paper side reversal section;

a clutch which transmits a driving force of the drive source to the carry roller having a possibility to nip and hold the paper when the paper is temporally stopped and held among the at least one carry roller only when the drive source is operating so that the return roller will carry the paper toward the return direction; and a carry control section which controls the paper carry by repeating a first step of feeding an n-th sheet of paper with an image formed on one side from the paper side reversal section to the image formation section, and feeding an n+1-th sheet of paper with an image formed on one side from the return section to the paper side reversal section, and a second step of ejecting the n-th sheet of paper with images formed on both sides, feeding an n+2-th sheet of paper into the image formation section, forming an image on one side of the n+2-th sheet of paper, and feeding the n+2-th sheet of paper to the return section, said second step being carried out while holding the n+1-th sheet of paper at the paper side reversal section.

2. An image forming apparatus according to claim 1, wherein the clutch is a one-way clutch.

3. An image forming apparatus according to claim 1, wherein the image formation mechanism performs image formation by electrophotography.

4. A paper carry controlling method for controlling paper carry in an image forming apparatus that comprises:

an image formation mechanism which forms an image on a paper;

a paper carry mechanism which carries the paper on a paper carry route, said paper carry route including: (i) an image formation section which carries the paper in a direction toward the image formation mechanism, (ii) a return section which takes in the paper from the image formation section and then carries out the paper in a return direction different from the direction toward the image formation section while reversing a carry direction, and (iii) a paper side reversal section which reverses the paper from a first side thereof which has passed the image formation section to a second side thereof and feeds the paper reversed to the second side thereof to the image formation section at a predetermined timing after temporally stopping and holding the paper carried out from the return section;

a drive source which rotates both a return roller provided in the paper carry mechanism in order to take in the paper from the image formation section to the return section and to carry out the paper from the return section to the return direction, and at least one carry roller provided in the paper carry mechanism in order to carry the paper at the paper side reversal section; and a clutch which transmits a driving force of the drive source to the carry roller having a possibility to nip and hold the paper when the paper is temporally stopped and held among the at least one carry roller only when the drive source is operating so that the return roller will carry the paper toward the return direction, wherein the paper carry controlling method comprises repeating a first step of feeding an n-th sheet of paper with an image formed on one side from the paper side reversal section to the image formation section, and feeding an n+1-th sheet of paper on with an image formed on one side from the return section to the paper side reversal section, and a second step of ejecting the n-th sheet of paper with images formed on both sides, feeding an n+2-th sheet of paper into the image formation section, forming an image on one side of the n+2-th sheet of paper, and feeding the n+2-th sheet of paper to the return section, said second step being carried out while holding the n+1-th sheet of paper at the paper side reversal section.

* * * * *